US007096838B1

(12) United States Patent
Sexton

(10) Patent No.: US 7,096,838 B1
(45) Date of Patent: Aug. 29, 2006

(54) REVERSIBLE FOUR CYCLE INTERNAL COMBUSTION ENGINE

(76) Inventor: Daniel W. Sexton, 6 Nevada St., Seldon, NY (US) 11784

( * ) Notice: Subject to any disclaimer, the term of this patent is extended or adjusted under 35 U.S.C. 154(b) by 0 days.

(21) Appl. No.: 11/105,335

(22) Filed: Apr. 13, 2005

(51) Int. Cl.
*F01L 1/04* (2006.01)

(52) U.S. Cl. ..... 123/90.6; 123/90.48; 123/90.61; 123/90.24; 123/79 R

(58) Field of Classification Search ..... 123/90.6, 123/90.48, 90.61, 90.24, 79 R
See application file for complete search history.

(56) References Cited

U.S. PATENT DOCUMENTS 1,950,561 A 3/1934 Matthew
2,815,010 A 12/1957 Miller
3,304,927 A 2/1967 Gorski
3,884,198 A 5/1975 Ito
4,748,945 A * 6/1988 Fujikawa et al. ..... 123/90.2
5,517,951 A 5/1996 Paul et al.
6,179,299 B1 * 1/2001 Schweiger ..... 277/598

* cited by examiner

*Primary Examiner*—Thomas Denion
*Assistant Examiner*—Zelalem Eshete
(74) *Attorney, Agent, or Firm*—Richard L. Miller

(57) ABSTRACT

A reversible four cycle internal combustion engine. A crankshaft is rotatably mounted in a block and a piston is operatively mounted to a crankshaft via a connecting rod. A follower wheel traverses a cam as the cam rotates with the crankshaft, and in doing so, causes a combustion chamber valve to open and close access of an intake port in the block and an exhaust port in the block to a combustion chamber in the block so as to allow the engine to achieve each of a power stroke thereof, a exhaust stroke thereof, a intake stroke thereof, and a compression stroke thereof.

52 Claims, 2 Drawing Sheets

REVERSIBLE FOUR CYCLE INTERNAL COMBUSTION ENGINE

BACKGROUND OF THE INVENTION

1. Field of the Invention

The present invention relates to an internal combustion engine, more particularly, the present invention relates to a reversible four cycle internal combustion engine.

2. Description of the Prior Art

Numerous innovations for engines have been provided in the prior art that will be described. Even though these innovations may be suitable for the specific individual purposes to which they address, however, they differ from the present invention.

A FIRST EXAMPLE, U.S. Pat. No. 1,950,561 to Matthew teaches in a reversing gear for internal combustion engines, in combination, means for supplying fuel to the engine, mechanism for operating the fuel-supplying means, means for automatically moving the mechanism into the position corresponding to the direction of rotation imparted to the engine, a valve for admitting starting air, valve gear for operating the valve means for placing the valve gear in two active positions and one inactive position with respect to the valve, means for throwing out the fuel-supplying valve when the valve gear is in its active position, and a controlling lever for operating the valve gear and the throwing-out means.

A SECOND EXAMPLE, U.S. Pat. No. 2,815,010 to Miller teaches in a reversing internal combustion engine, a cylinder and piston mounted for reciprocation therein, a valve-and-port mechanism for controlling the admission of inlet air and the exhaustion of burnt gases, and a valve actuating mechanism including means for closing the valve-and-port mechanism when the piston is a substantial distance on one side of bottom dead center to entrap inlet air for compression while the engine is running in one direction of rotation, and means for closing the valve-and-port mechanism when the piston is a substantial distance on the other side of bottom dean center to entrap inlet air for compression while the engine is running in the other direction of rotation, the valve actuating mechanism being constructed and arranged to close the valve-and-port mechanism ahead of the piston's bottom dead center position while the engine is turning in an ahead direction of rotation and adapted to close the valve-and-port mechanism behind the piston's bottom dead center position while the engine is turning in an astern direction of rotation.

A THIRD EXAMPLE, U.S. Pat. No. 3,304,927 to Gorski teaches a starting circuit for an internal combustion engine having starting motor means for reversibly starting the engine, the circuit comprising the combination of a source of electrical current, a pair of solenoids operable selectively to energize the motor means for engine starting in opposite rotative directions, first switch means electrically coupled to the current source and operable to selectively energize the solenoids, an ignition coil, second switch means electrically coupled to the ignition coil and including a pair of contacts selectively electrically coupled to the ignition coil, third switch means electrically coupled to the current source and to the pair of contacts, the third switch means being operable to selectively electrically couple the contacts to the current source, and means mechanically connecting the second switch means and the solenoids to electrically couple one of the contacts with the ignition coil in response to energizing of one of the solenoids and to electrically couple the other of the contacts with the ignition coil in response to energizing of the other of the solenoids.

A FOURTH EXAMPLE, U.S. Pat. No. 3,884,198 to Ito teaches in a cam shaft for actuating suction and exhaust valves of a four cycle reversible internal combustion engine of the class wherein the cam shaft is provided with a plurality of cams and the cam shaft is moved axially to select two cams for actuating suction and exhaust valve operating rods for effecting forward or reverse rotation of the engine, there are provided three spaced apart cams on the cam shaft, an intermediate cam of which serves as, for example, a cam for actuating the suction valve upon forward rotation and for actuating the exhaust valve upon reverse rotation, the spacing between adjacent two cams being made equal to the spacing between adjacent operating rods for suction and exhaust valves of the engine whereby the inclination angle of the inclined surfaces between the two adjacent cams can be reduced.

A FIFTH EXAMPLE, U.S. Pat. No. 5,517,951 to Paul, et al. teaches a universal internal combustion engine that is electronically and reversibly convertible from four stroke operation to two stroke operation, the engine having intake and exhaust valves with an electro-hydraulic actuator system for actuating the valves in accordance with electronic control signals from an electronic control module, the electro-hydraulic actuator system having an electronic actuator for each valve coupled to a slide valve for discrete supply of a pressurized hydraulic fluid to a hydraulic piston for each valve, the electronic control module having a program for independent activation of each electronic actuator for select operation of each intake and exhaust valve at any time during the operating cycle.

It is apparent that numerous innovations for engines have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a reversible four cycle internal combustion engine that avoids the disadvantages of the prior art.

ANOTHER OBJECT of the present invention is to provide a reversible four cycle internal combustion engine that is simple to use.

BRIEFLY STATED, STILL ANOTHER OBJECT of the present invention is to provide a reversible four cycle internal combustion engine. A crankshaft is rotatably mounted in a block and a piston is operatively mounted to a crankshaft via a connecting rod. A follower wheel traverses a cam as the cam rotates with the crankshaft, and in doing so, causes a combustion chamber valve to open and close access of an intake port in the block and an exhaust port in the block to a combustion chamber in the block so as to allow the engine to achieve each of a power stroke thereof, a exhaust stroke thereof, a intake stroke thereof, and a compression stroke thereof.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 2:
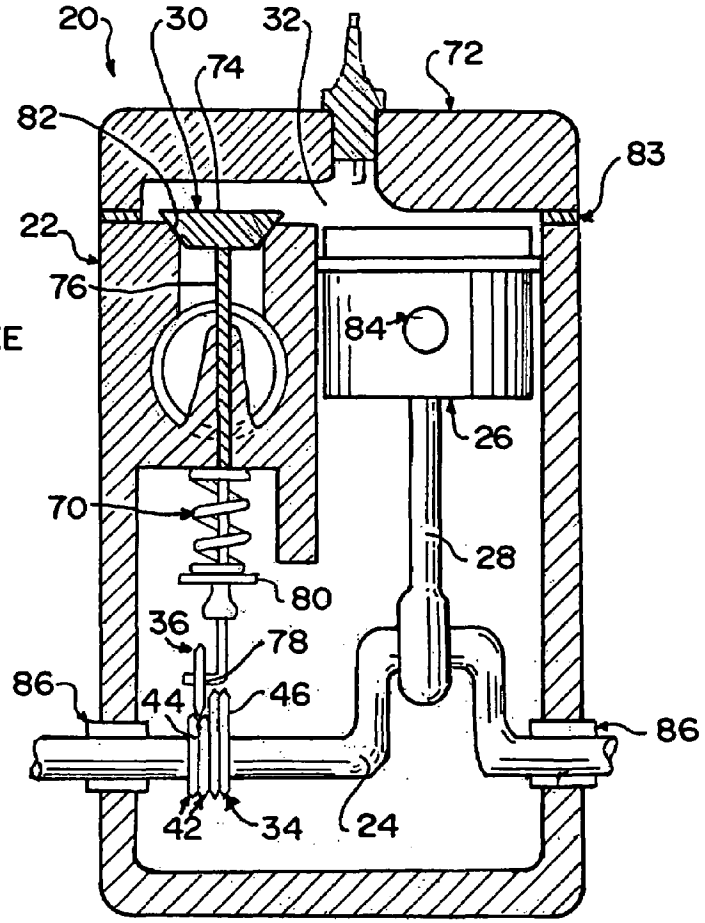
FIG. 2 is a diagrammatic cross sectional view taken along LINE 2—2 in FIG. 1.

20 reversible four cycle internal combustion engine of present invention
22 block
24 crankshaft
26 piston
28 connecting rod
30 combustion chamber valve
32 combustion chamber in block 22
34 cam
36 follower wheel
38 intake port in block 22
40 exhaust port in block 22
42 pair of pulley-like wheels of cam 34
44 small pulley-like wheel of pair of pulley-like wheels 42 of cam 34
46 large pulley-like wheel of pair of pulley-like wheels 42 of cam 34
48 crossover portion of cam
50 intake valve
52 intake port valve seat of intake port 38 in block 22
54 intake port spring seat of intake port 38 in block 22
56 intake valve head of intake valve 50
58 intake valve spring of intake valve 50
60 exhaust valve
62 exhaust port valve seat of exhaust port 40 in block 22
64 exhaust port spring seat of exhaust port 40 in block 22
66 exhaust valve head of exhaust valve 60
68 exhaust valve spring of exhaust valve 60
70 combustion chamber valve spring
72 head
74 combustion chamber valve head of combustion chamber valve 30
76 combustion chamber valve stem of combustion chamber valve 30
78 combustion chamber valve stem end of combustion chamber valve stem 76 of combustion chamber valve 30
80 combustion chamber valve retainer of combustion chamber valve 30
82 combustion chamber valve seat of combustion chamber 32 in block 22
83 head gasket
84 wrist pin
86 main bearings

DETAILED DESCRIPTION OF THE PREFERRED EMBODIMENT

Figure 1:
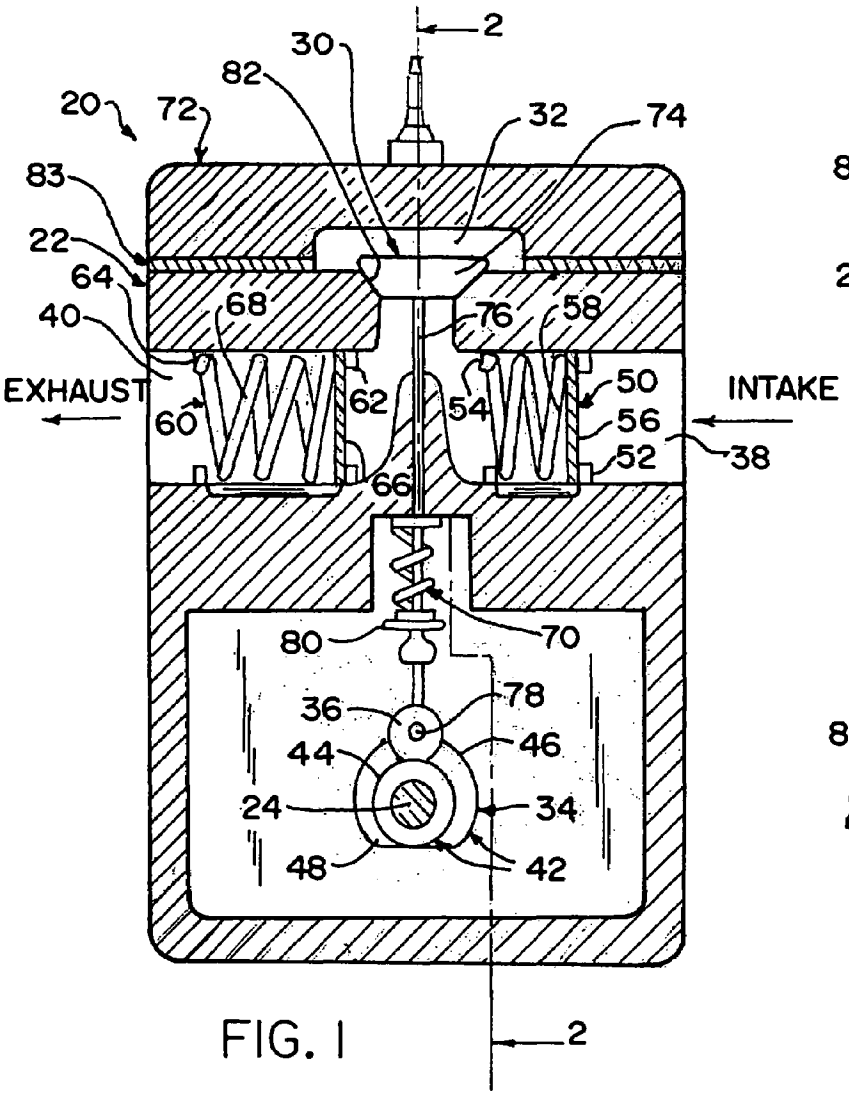
FIG. 1 is a diagrammatic cross sectional view of the reversible four cycle internal combustion engine of the present invention.

Referring now to the figures, in which like numerals indicate like parts, and particularly to FIGS. 1 and 2, which are, respectively, a diagrammatic cross sectional view of the reversible four cycle internal combustion engine of the present invention and a diagrammatic cross sectional view taken along LINE 2—2 in FIG. 1, the reversible four cycle internal combustion engine of the present invention is shown generally at 20.

The reversible four cycle internal combustion engine comprises a block 22, a crankshaft 24, a piston 26, and a connecting rod 28. The crankshaft 24 is rotatably mounted in the block 22 and the piston 26 is operatively mounted to the crankshaft 24 via the connecting rod 28.

The engine 20 further comprises a combustion chamber valve 30 and has a power stroke, an exhaust stroke, an intake stroke, and a compression stroke and the block 22 contains a combustion chamber 32. The combustion chamber valve 30 traverses the crankshaft 24 as the crankshaft 24 rotates, and in doing so, causes the combustion chamber valve 30 to open and close access to the combustion chamber 32 in the block 22 so as to allow the engine 20 to achieve each of the power stroke thereof, the exhaust stroke thereof, the intake stroke thereof, and the compression stroke thereof.

The engine 20 further comprises a cam 34. The cam 34 is fixedly attached to the crankshaft 24.

The engine 20 further comprises a follower wheel 36. The follower wheel 36 is rotatable mounted to the combustion chamber valve 30.

The block 22 has an intake port 38 and an exhaust port 40. The follower wheel 36 traverses the cam 34 as the cam 34 rotates with the crankshaft 24, and in doing so, causes the combustion chamber valve 30 to open and close access of the intake port 38 in the block 22 and the exhaust port 40 in the block 22 to the combustion chamber 32 in the block 22 so as to allow the engine 20 to achieve of each of the power stroke thereof, the exhaust stroke thereof, the intake stroke thereof, and the compression stroke thereof.

The cam comprises 34 a pair of pulley-like wheels 42. The pair of pulley-like wheels 42 of the cam 34 are disposed face-to-face and are coaxial.

Each pulley-like wheel 42 of the cam 34 has a radius. The radius of one pulley-like wheel 42 of the cam 34 is smaller than the radius of the other pulley-like wheel 42 of the cam 34 so as to form a small pulley-like wheel 44 of the cam 34 and a large pulley-like wheel 46 of the cam 34.

The small pulley-like wheel 44 of the cam 34 has a perimeter and the large pulley-like wheel 46 of the cam 34 has a perimeter. A portion of the perimeter of the large pulley-like wheel 46 of the cam 34 is substantially flat so as to form a crossover portion 48 of the cam 34. A portion of the perimeter of the small pulley-like wheel 44 of the cam 34 aligns with the crossover portion 48 of the perimeter of the large pulley-like wheel 46 of the cam 34 so as to allow the pair of pulley-like wheels 42 of the cam 34 to be coaxial.

The pair of pulley-like wheels 42 of the cam 34 are traversed by the follower wheel 36. The crossover portion 48 of the perimeter of the large pulley-like wheel 46 of the cam 34 allows the follower wheel 36 to traverse back and forth between the large pulley-like wheel 46 of the cam 34 and small pulley-like wheel 44 of the cam 34.

The engine 20 further comprises an intake valve 50. The intake valve 50 selectively opens and closes the intake port 38 in the block 22.

The intake port 38 in the block 22 has an intake port valve seat 52 and an intake port spring seat 54.

The intake valve 50 comprises an intake valve head 56 that is preferably flat and an intake valve spring 58. The intake valve head 56 of the intake valve 50 is biased against the intake port valve seat 52 of the intake port 38 in the block 22 by the intake valve spring 58 of the intake valve 50 which sits against the intake port spring seat 54 of the intake port 38 in the block 22.

The engine 20 further comprises an exhaust valve 60. The exhaust valve 60 selectively opens and closes the exhaust port 40 in the block 22.

The exhaust port 40 in the block 22 has an exhaust port valve seat 62 and an exhaust port spring seat 64.

The exhaust valve 60 comprises an exhaust valve head 66 that is preferably flat and an exhaust valve spring 68. The exhaust valve head 66 of the exhaust valve 60 is biased against the exhaust port valve seat 62 of the exhaust port 40 in the block 22 by the exhaust valve spring 68 of the exhaust valve 60 which sits against the exhaust port spring seat 64 of the exhaust port 40 in the block 22.

The engine 20 further comprises a combustion chamber valve spring 70 and a head 72. The combustion chamber valve spring 70 biases the combustion chamber valve 30 closed. The head 72 is replaceably attached to the block 22 and together therewith define the combustion chamber 32 in the block 22.

The combustion chamber valve 30 has a combustion chamber valve head 74 and a combustion chamber valve stem 76 with a combustion chamber valve stem end 78. The combustion chamber valve stem end 78 of the combustion chamber valve 30 is furthest away from the combustion chamber valve head 74 of the combustion chamber valve 30. The follower wheel 36 is rotatably attached to the combustion chamber valve stem end 78 of the combustion chamber valve 30.

The combustion chamber valve 30 has a combustion chamber valve retainer 80 and the combustion chamber 32 in the block 22 has a combustion chamber valve seat 82. The combustion chamber valve spring 70 of the combustion chamber valve 30 encircles the combustion chamber valve stem 76 of the combustion chamber valve 30 and is retained therearound by the combustion chamber valve retainer 80 of the combustion chamber valve 30.

The engine 20 further comprises a head gasket 83. The head gasket 83 seals the head 72 against the block 22.

The engine 20 further comprises a wrist pin 84. The wrist pin 84 movable attaches the piston 26 to the connecting rod 28.

The engine 20 further comprises main bearings 86. The main bearings 86 rotatably mount the crankshaft 24 in the block 22.

Figures 3, 4, 5, 6, 7, 8, 9, 10, 11:
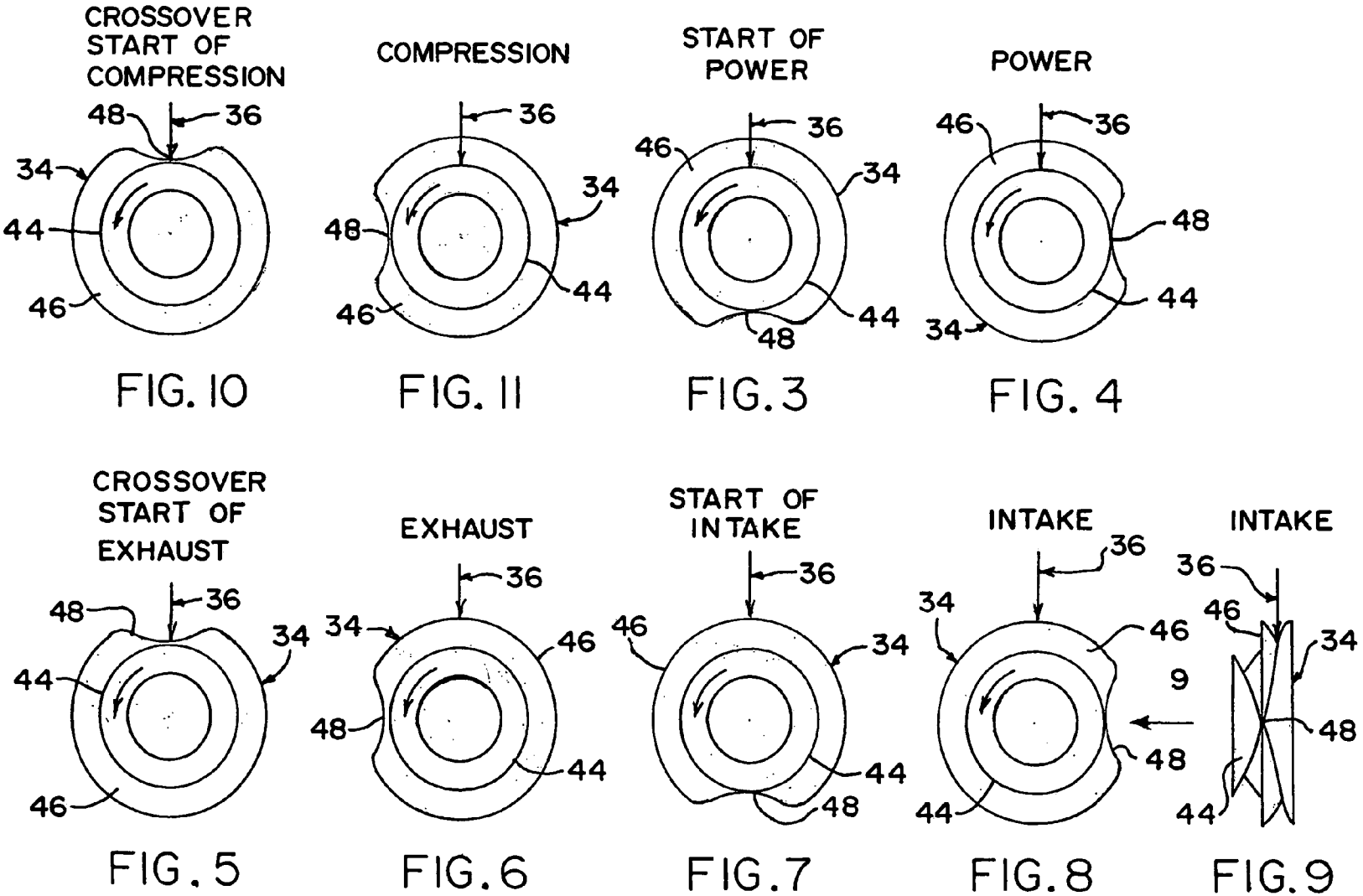
FIG. 3 is a diagrammatic front elevational view of the orientation of the cam of the reversible four cycle internal combustion engine of the present invention and its relationship to the follower wheel of the reversible four cycle internal combustion engine of the present invention at the start of the power stroke of the reversible four cycle internal combustion engine of the present invention.
FIG. 4 is a diagrammatic front elevational view of the orientation of the cam of the reversible four cycle internal combustion engine of the present invention and its relationship to the follower wheel of the reversible four cycle internal combustion engine of the present invention during the power stroke of the reversible four cycle internal combustion engine of the present invention.
FIG. 5 is a diagrammatic front elevational view of the orientation of the cam of the reversible four cycle internal combustion engine of the present invention and its relationship to the follower wheel of the reversible four cycle internal combustion engine of the present invention at the start of the exhaust stroke of the reversible four cycle internal combustion engine of the present invention.
FIG. 6 is a diagrammatic front elevational view of the orientation of the cam of the reversible four cycle internal combustion engine of the present invention and its relationship to the follower wheel of the reversible four cycle internal combustion engine of the present invention during the exhaust stroke of the reversible four cycle internal combustion engine of the present invention.
FIG. 7 is a diagrammatic front elevational view of the orientation of the cam of the reversible four cycle internal combustion engine of the present invention and its relationship to the follower wheel of the reversible four cycle internal combustion engine of the present invention at the start of the intake stroke of the reversible four cycle internal combustion engine of the present invention.
FIG. 8 is a diagrammatic front elevational view of the orientation of the cam of the reversible four cycle internal combustion engine of the present invention and its relationship to the follower wheel of the reversible four cycle internal combustion engine of the present invention during the intake stroke of the reversible four cycle internal combustion engine of the present invention.
FIG. 9 is a diagrammatic side elevational view of the orientation of the cam of the reversible four cycle internal combustion engine of the present invention and its relationship to the follower wheel of the reversible four cycle internal combustion engine of the present invention during the intake stroke of the reversible four cycle internal combustion engine of the present invention taken in the direction of arrow 9 in FIG. 8.
FIG. 10 is a diagrammatic front elevational view of the orientation of the cam of the reversible four cycle internal combustion engine of the present invention and its relationship to the follower wheel of the reversible four cycle internal combustion engine of the present invention at the start of the compression stroke of the reversible four cycle internal combustion engine of the present invention.
FIG. 11 is a diagrammatic front elevational view of the orientation of the cam of the reversible four cycle internal combustion engine of the present invention and its relationship to the follower wheel of the reversible four cycle internal combustion engine of the present invention during the compression stroke of the reversible four cycle internal combustion engine of the present invention.

As shown in FIG. 10, which is a diagrammatic front elevational view of the orientation of the cam of the reversible four cycle internal combustion engine of the present invention and its relationship to the follower wheel of the reversible four cycle internal combustion engine of the present invention at the start of the compression stroke of the reversible four cycle internal combustion engine of the present invention, the follower wheel 36 crosses over the crossover 48 of the cam 34 onto the small pulley-like wheel 44 of the cam 34 at the start of the compression stroke of the engine 20.

As shown in FIG. 11, which is a diagrammatic front elevational view of the orientation of the cam of the reversible four cycle internal combustion engine of the present invention and its relationship to the follower wheel of the reversible four cycle internal combustion engine of the present invention during the compression stroke of the reversible four cycle internal combustion engine of the present invention, follower wheel 36 remains on the small pulley-like wheel 44 of the cam 34, but is 90 degrees clockwise from the crossover 48 of the cam 34 during the compression stroke of the engine 20.

As shown in FIG. 3, which is a diagrammatic front elevational view of the orientation of the cam of the reversible four cycle internal combustion engine of the present invention and its relationship to the follower wheel of the reversible four cycle internal combustion engine of the present invention at the start of the power stroke of the reversible four cycle internal combustion engine of the present invention, the follower wheel 36 remains on the small pulley-like wheel 44 of the cam 34, but is 180 degrees clockwise from the crossover portion 48 of the cam 34 at the start of the power stroke of the engine 20.

As shown in FIG. 4, which is a diagrammatic front elevational view of the orientation of the cam of the reversible four cycle internal combustion engine of the present invention and its relationship to the follower wheel of the reversible four cycle internal combustion engine of the present invention during the power stroke of the reversible four cycle internal combustion engine of the present invention, the follower wheel 36 remains on the small pulley-like wheel 44 of the cam 34, but is 270 degrees clockwise from the crossover 48 of the cam 34 during the power stroke of the engine 20.

As shown in FIG. 5, which is a diagrammatic front elevational view of the orientation of the cam of the reversible four cycle internal combustion engine of the present invention and its relationship to the follower wheel of the reversible four cycle internal combustion engine of the present invention at the start of the exhaust stroke of the reversible four cycle internal combustion engine of the present invention, the follower wheel 36 crosses over the crossover 48 of the cam 34 onto the large pulley-like wheel 46 of the cam 34 at the start of the exhaust stroke of the engine 20.

As shown in FIG. 6, which is a diagrammatic front elevational view of the orientation of the cam of the reversible four cycle internal combustion engine of the present invention and its relationship to the follower wheel of the reversible four cycle internal combustion engine of the present invention during the exhaust stroke of the reversible four cycle internal combustion engine of the present invention, the follower wheel 36 remains on the large pulley-like wheel 46 of the cam 34, but is 90 degrees clockwise from the crossover 48 of the cam 34 during the exhaust stroke of the engine 20, thereby opening the combustion chamber valve 30 and allowing pressurized contents of the combustion chamber 32 in the block 22 to exit therefrom causing only the exhaust valve 60 and not the intake valve 50 to open based upon check valve orientations of the intake valve 50 and the exhaust valve 60.

As shown in FIG. 7, which is a diagrammatic front elevational view of the orientation of the cam of the reversible four cycle internal combustion engine of the present invention and its relationship to the follower wheel of the reversible four cycle internal combustion engine of the present invention at the start of the intake stroke of the reversible four cycle internal combustion engine of the present invention, the follower wheel 36 remains on the large pulley-like wheel 44 of the cam 34, but is 180 degrees clockwise from the crossover 48 of the cam 34 at the start of the intake stroke of the engine 20.

As shown in FIGS. 8 and 9, which are, respectively, a diagrammatic front elevational view of the orientation of the cam of the reversible four cycle internal combustion engine of the present invention and its relationship to the follower wheel of the reversible four cycle internal combustion engine of the present invention during the intake stroke of the reversible four cycle internal combustion engine of the present invention; and a diagrammatic side elevational view of the orientation of the cam of the reversible four cycle internal combustion engine of the present invention and its relationship to the follower wheel of the reversible four cycle internal combustion engine of the present invention during the intake stroke of the reversible four cycle internal combustion engine of the present invention taken in the direction of arrow 9 in FIG. 8, the follower wheel 36 remains on the large pulley-like wheel 46 of the cam 34, but is 270 degrees clockwise from the crossover 48 of the cam during the intake stroke of the engine 20, thereby opening the combustion chamber valve 30 and allowing pressurized charge to open the intake valve 50 and enter the unpressurized combustion chamber 32 in the block 22.

So it can be seen that pressure state in the combustion chamber 32 in the block 22 will determine whether the intake valve 50 or the exhaust valve 60 will open.

It will be understood that each of the elements described above, or two or more together, may also find a useful application in other types of constructions differing from the types described above.

While the invention has been illustrated and described as embodied in a reversible four cycle internal combustion engine, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A reversible four cycle internal combustion engine, comprising:

a) a block;

b) a crankshaft;

c) a piston; and d) a connecting rod;

wherein said crankshaft is rotatable mounted in said block; and wherein said piston is operatively mounted to said crankshaft via said connecting rod, further comprising a combustion chamber valve;

wherein said engine has a power stroke;

wherein said engine has an exhaust stroke;

wherein said engine has an intake stroke;

wherein said engine has a compression stroke;

wherein said block contains a combustion chamber; and wherein said combustion chamber valve traverses said crankshaft as said crankshaft rotates, and in doing so, causes said combustion chamber valve to open and close access to said combustion chamber in said block so as to allow said engine to achieve each of said power stroke thereof, said exhaust stroke thereof, said intake stroke thereof, and said compression stroke thereof, further comprising a cam, further comprising a follower wheel, wherein said block has an intake port, wherein said cam comprises a pair of pulley-like wheels.

2. The engine as defined in claim 1, wherein said cam is fixedly attached to said crankshaft.

3. The engine as defined in claim 1, wherein said follower wheel is rotatable mounted to said combustion chamber valve.

4. The engine as defined in claim 1, wherein said pair of pulley-like wheels of said cam are disposed face-to-face.

5. The engine as defined in claim 1, wherein said pair of pulley-like wheels of said cam are coaxial.

6. The engine as defined in claim 1, wherein each said pulley-like wheel of said cam has a radius; and wherein said radius of said one pulley-like wheel of said cam is smaller than said radius of said other pulley-like wheel of said cam so as to form a small pulley-like wheel of said cam and a large pulley-like wheel of said cam.

7. The engine as defined in claim 1, wherein said pair of pulley-like wheels of said cam are traversed by said follower wheel.

8. The engine as defined in claim 1, further comprising a combustion chamber valve spring.

9. The engine as defined in claim 1, further comprising a head.

10. The engine as defined in claim 1, further comprising a wrist pin.

11. The engine as defined in claim 1, further comprising main bearings.

12. The engine as defined in claim 6, wherein said small pulley-like wheel of said cam has a perimeter; and wherein said large pulley-like wheel of said cam has a perimeter.

13. The engine as defined in claim 12, wherein a portion of said perimeter of said large pulley-like wheel of said cam is substantially flat so as to form a crossover portion of said cam.

14. The engine as defined in claim 13, wherein a portion of said perimeter of said small pulley-like wheel of said cam aligns with said crossover portion of said perimeter of said large pulley-like wheel of said cam so as to allow said pair of pulley-like wheels of said cam to be coaxial.

15. The engine as defined in claim 13, wherein said crossover portion of said perimeter of said large pulley-like wheel of said cam allows said follower wheel to traverse back and forth between said large pulley-like wheel of said cam and said small pulley-like wheel of said cam.

16. The engine as defined in claim 13, further comprising an intake valve.

17. The engine as defined in claim 13, wherein said follower wheel crosses over said crossover of said cam onto said small pulley-like wheel of said cam at the start of said compression stroke of said engine.

18. The engine as defined in claim 13, wherein said follower wheel remains on said small pulley-like wheel of said cam, but is 90 degrees clockwise from said crossover of said cam during said compression stroke of said engine.

19. The engine as defined in claim 13, wherein said follower wheel remains on said small pulley-like wheel of said cam, but is 180 degrees clockwise from said crossover of said cam at the start of said power stroke of said engine.

20. The engine as defined in claim 13, wherein said follower wheel remains on said small pulley-like wheel of said cam, but is 270 degrees clockwise from said crossover of said cam during said power stroke of said engine.

21. The engine as defined in claim 13, wherein said follower wheel crosses over said crossover of said cam onto said large pulley-like wheel of said cam at the start of said exhaust stroke of said engine.

22. The engine as defined in claim 13, wherein said follower wheel remains on said large pulley-like wheel of said cam, but is 180 degrees clockwise from said crossover of said cam at the start of said intake stroke of said engine.

23. The engine as defined in claim 16, wherein said intake valve selectively opens and closes said intake port in said block.

24. The engine as defined in claim 16, wherein said intake port in said block has an intake port valve seat.

25. The engine as defined in claim 16, further comprising an exhaust valve.

26. The engine as defined in claim 24, wherein said intake port in said block has an intake port spring seat.

27. The engine as defined in claim 26, wherein said intake valve comprises an intake valve head.

28. The engine as defined in claim 27, wherein said intake valve head of said intake valve is flat.

29. The engine as defined in claim 27, wherein said intake valve comprises an intake valve spring.

30. The engine as defined in claim 29, wherein said intake valve head of said intake valve is biased against said intake port valve seat of said intake port in said block by said intake valve spring of said intake valve which sits against said intake port spring seat of said intake port in said block.

31. The engine as defined in claim 25, wherein said exhaust valve selectively opens and closes said exhaust port in said block.

32. The engine as defined in claim 25, wherein said follower wheel remains on said large pulley-like wheel of said cam, but is 90 degrees clockwise from said crossover of said cam during said exhaust stroke of said engine, thereby opening said combustion chamber valve and allowing pressurized contents of said combustion chamber in said block to exit therefrom causing only said exhaust valve and not said intake valve to open based upon check valve orientations of said intake valve and said exhaust valve.

33. The engine as defined in claim 25, wherein said follower wheel remains on said large pulley-like wheel of said cam, but is 270 degrees clockwise from said crossover of said cam during said intake stroke of said engine, thereby opening said combustion chamber valve and allowing pressurized charge to open said intake valve and enter unpressurized said combustion chamber in said block.

34. The engine as defined in claim 25, wherein said combustion chamber in said block has a pressure state; and wherein said pressure state in said combustion chamber in said block determines whether said intake valve or said exhaust valve will open.

35. The engine as defined in claim 31, wherein said exhaust port in said block has an exhaust port valve seat.

36. The engine as defined in claim 35, wherein said exhaust port in said block has an exhaust port spring seat.

37. The engine as defined in claim 36, wherein said exhaust valve comprises an exhaust valve head.

38. The engine as defined in claim 37, wherein said exhaust valve head of said exhaust valve is flat.

39. The engine as defined in claim 37, wherein said exhaust valve comprises an exhaust valve spring.

40. The engine as defined in claim 39, wherein said exhaust valve head of said exhaust valve is biased against said exhaust port valve seat of said exhaust port in said block by said exhaust valve spring of said exhaust valve which sits against said exhaust port spring seat of said exhaust port in said block.

41. The engine as defined in claim 8, wherein said combustion chamber valve spring biases said combustion chamber valve closed.

42. The engine as defined in claim 8, wherein said combustion chamber valve has a combustion chamber valve head;

wherein said combustion chamber valve has a combustion chamber valve stem;

wherein said combustion chamber valve stem of said combustion chamber valve has a combustion chamber valve stem end; and wherein said combustion chamber valve stem end of said combustion chamber valve is furthest away from said combustion chamber valve head of said combustion chamber valve.

43. The engine as defined in claim 42, wherein said combustion chamber valve has a combustion chamber valve retainer.

44. The engine as defined in claim 42, wherein said follower wheel is rotatably attached to said combustion chamber valve stem end of said combustion chamber valve.

45. The engine as defined in claim 43, wherein said combustion chamber in said block has a combustion chamber valve seat.

46. The engine as defined in claim 45, wherein said combustion chamber valve spring of said combustion chamber valve encircles said combustion chamber valve stem of said combustion chamber valve and is retained therearound by said combustion chamber valve retainer of said combustion chamber valve.

47. The engine as defined in claim 9, wherein said head is replaceably attached to said block.

48. The engine as defined in claim 9, wherein said head together with said block define said combustion chamber in said block.

49. The engine as defined in claim 9, further comprising a head gasket.

50. The engine as defined in claim 49, wherein said head gasket seals said head against said block.

51. The engine as defined in claim 10, wherein said wrist pin movable attaches said piston to said connecting rod.

52. The engine as defined in claim 11, wherein said main bearings rotatably mount said crankshaft in said block.

* * * * *